US008337666B2

(12) United States Patent
Johnson et al.

(10) Patent No.: US 8,337,666 B2
(45) Date of Patent: Dec. 25, 2012

(54) SYSTEMS AND METHODS FOR PROVIDING IMPROVED DEWATERING PERFORMANCE IN A PAPERMAKING MACHINE

(75) Inventors: Robert P. Johnson, Sutton, MA (US); David Leeman, Worcester, MA (US); Allen J. Brauns, Sturbridge, MA (US)

(73) Assignee: Kadant, Inc., Westford, MA (US)

( * ) Notice: Subject to any disclaimer, the term of this patent is extended or adjusted under 35 U.S.C. 154(b) by 18 days.

(21) Appl. No.: 12/692,968

(22) Filed: Jan. 25, 2010

(65) Prior Publication Data

US 2010/0200187 A1 Aug. 12, 2010

Related U.S. Application Data

(60) Provisional application No. 61/146,885, filed on Jan. 23, 2009.

(51) Int. Cl.
*D21F 1/32* (2006.01)

(52) U.S. Cl. ..... 162/199; 162/272

(58) Field of Classification Search ..... 162/199, 162/272, 281, 358.1–358.5, 361, 363, 367, 162/373; 15/301, 303, 309.1, 312.1; 118/70, 118/413

See application file for complete search history.

(56) References Cited

U.S. PATENT DOCUMENTS

| | | | | |
|---|---|---|---|---|
| 2,352,220 | A * | 6/1944 | Overton | 34/392 |
| 3,010,134 | A | 11/1961 | Goyette | |
| 3,149,005 | A * | 9/1964 | Brundige | 118/70 |
| 3,264,673 | A * | 8/1966 | Scott | 15/308 |
| 3,624,860 | A * | 12/1971 | Grimston | 15/308 |
| 4,185,399 | A * | 1/1980 | Gladish | 34/120 |
| 4,700,493 | A | 10/1987 | Wedel et al. | |
| 4,953,252 | A | 9/1990 | Akisawa | |
| 5,021,124 | A | 6/1991 | Turtinen et al. | |
| 5,597,449 | A | 1/1997 | Vestola et al. | |
| 5,657,693 | A | 8/1997 | Kumaki et al. | |
| 6,139,638 | A * | 10/2000 | Dubois et al. | 118/413 |
| 6,386,106 | B1 | 5/2002 | Stanka | |
| 6,447,646 | B1 | 9/2002 | Hassinen et al. | |
| 6,491,791 | B1 * | 12/2002 | Loippo | 162/199 |
| 6,687,950 | B1 * | 2/2004 | Rata et al. | 15/256.51 |
| 6,942,734 | B2 | 9/2005 | Rata et al. | |
| 2005/0098292 | A1 * | 5/2005 | Ried et al. | 162/281 |
| 2006/0054293 | A1 | 3/2006 | Strauch | |
| 2006/0180291 | A1 | 8/2006 | Rata | |
| 2006/0289141 | A1 | 12/2006 | Rata et al. | |

FOREIGN PATENT DOCUMENTS

| | | |
|---|---|---|
| DE | 4108167 A1 | 9/1992 |
| WO | WO 99/37856 | 7/1999 |
| WO | WO 2009/108754 | 9/2009 |

* cited by examiner

*Primary Examiner* — Mark Halpern
(74) *Attorney, Agent, or Firm* — Gesmer Updegrove LLP

(57) ABSTRACT

A doctoring system is disclosed for a papermaking machine wherein the doctoring system includes a doctor blade and a fluid assist means. The doctor blade is coupled to a doctor blade holder, and is for cleaning a moving surface. The doctor blade holder is coupled to a doctor-back. The fluid assist means is for providing a fluid under positive pressure that is higher than atmospheric pressure and is directed in a direction generally along a direction of movement of the moving surface such that a negative pressure that is lower than atmospheric pressure develops in a negative pressure zone adjacent the moving surface and a following surface of the doctor blade during movement of the moving surface.

20 Claims, 14 Drawing Sheets

SYSTEMS AND METHODS FOR PROVIDING IMPROVED DEWATERING PERFORMANCE IN A PAPERMAKING MACHINE

PRIORITY

This application claims priority to U.S. Ser. No. 61/146,885 filed Jan. 23, 2009, the disclosure of which is hereby incorporated in its entirety.

BACKGROUND

1. Field of the Invention

This invention relates to doctor blade systems, and is concerned in particular with an improved design that facilitates water or debris removal performance while maintaining desired doctor blade holder performance.

2. Description of the Prior Art

Many roll cleaning and sheet shedding applications on paper machines and other web handling applications involve doctor blade support devices commonly referred to as doctor blade holders. Typically, a doctor blade holder is mounted on a doctor-back, which is a heavy-duty beam that spans the paper machine width. The rear portion of a doctor blade is received into the holder, which supports the blade in a predetermined position relative to a surface to be cleaned. The holder works in concert with the doctoring assembly to apply the working edge of the blade, found on the blade's front portion, to an adjacent moving surface.

Certain conventional doctoring apparatus for paper machines are equipped with double doctors; the primary doctor cleans the surface of the roll, while the secondary blade carries away water and debris that may have dislodged from machined features such as through holes, blind holes or grooves in the moving surface, typically under affect of centrifugal force, with some additional influence from a reduction in fluid surface tension. This is, however, often not sufficient to adequately dewater the rolls.

U.S. Pat. No. 6,491,791 discloses a method and apparatus to clean roll surfaces or fabrics used in papermaking machines, wherein a doctoring element includes one or two integral doctor blades as well as an integral gas chamber that provides pressurized gas, e.g., compressed air, to the outgoing side of a doctoring apparatus having one doctor blade, and to the inter-blade area of a doctoring apparatus having two doctor blades. The compressed air is provided to enhance the water or dirt removal capabilities. Each of the disclosed apparatus, however, involves doctor blades that are integral with the structure forming the gas chamber within the doctoring element.

The use of such integral doctor blades requires that the entire doctoring element be replaced whenever the doctor blades become too worn. The doctoring apparatus are also not disclosed to be position adjustable with respect to the roll, and it is not at all clear how such an integral gas chamber may be incorporated in a doctoring apparatus that provides adjustable position accuracy with respect to a roll as well as flexibility in doctoring a roll along an elongated length of the doctor blade. Further shortcomings of such systems include: 1) The apparatus is not integral with the holder. 2) The apparatus is part of the blade and thus when it is worn or damaged it must be replaced, which is very costly. 3) The apparatus is very rigid and lacks the ability to conform well to the roll surface. 4) The air discharge features and geometry used for the purpose of dewatering can fail to produce adequate dewatering. 5) The apparatus air discharge is always open allowing contaminants to enter from the ambient when the device is not pressurized; the ingress of contaminants may be avoided by applying pressurized air when the machine is under maintenance, but with the disadvantage of the added cost associated with it.

U.S. Pat. No. 6,139,638 discloses a doctor blade holder apparatus that includes a planar upper holding member that is pivotally mounted to a tray such that the position of the upper holding member with respect to the tray may be adjusted by unloading and loading tubes. The upper holding member also includes a plurality of distribution passages that are coupled respectively off of the upper holding member via a plurality of branch conduits to a common header. The pressurized fluid, therefore, must separately travel through the conduits to reach each of the individual areas along the doctor blade holder apparatus, while maintaining sufficiently equalized pressure as the fluid is directed toward the roll along the elongated length of the doctor blade.

There remains a need, therefore, for a cost effective doctor blade holder system that facilitates consistent debris removal without limiting the flexibility of the doctor blade holder system or the effectiveness of the doctoring process, and in particular that improves the dewatering performance of a doctor apparatus operating on various paper machine rolls, while retaining or improving the cleaning performance of the doctor blade, such as, for example in a machine for doctoring a paper machine suction press.

SUMMARY

In accordance with an embodiment, the invention provides a doctoring system for a papermaking machine wherein the doctoring system includes a doctor blade and a fluid assist means. The doctor blade is coupled to a doctor blade holder, and is for cleaning a moving surface. The doctor blade holder is coupled to a doctor-back. The fluid assist means is for providing a fluid under positive pressure that is higher than atmospheric pressure and is directed in a direction generally along a direction of movement of the moving surface such that a negative pressure that is lower than atmospheric pressure develops in a negative pressure zone adjacent the moving surface and a following surface of the doctor blade during movement of the moving surface In accordance with another embodiment, the doctor blade is for de-watering a roll that includes holes, and the fluid assist means is for providing air under positive pressure that is higher than atmospheric pressure. The air is directed in a direction generally along a direction of rotation of the roll such that a negative pressure that is lower than atmospheric pressure develops in a negative pressure zone adjacent the moving surface and a following surface of the doctor blade during rotation of the roll for drawing water from within the holes in the roll surface.

In accordance with a further embodiment, the invention provides a method of treating a roll surface during papermaking. The method includes the steps of coupling a doctor blade holder to a doctor-back using, pivotally adjusting the doctor blade with respect to the doctor-back, and providing a positive air pressure that is higher than atmospheric pressure. The positive air pressure causes air to be directed in a direction that is generally toward a direction of rotation of the roll such that a negative pressure that is lower than atmospheric pressure is provided in a negative pressure area adjacent a surface of the roll and adjacent a following surface of the doctor blade and doctor blade holder during rotation of the roll.

BRIEF DESCRIPTION OF THE DRAWINGS

The following description may be further understood with reference to the accompanying drawings in which.

The drawings are shown for illustrative purposes only and are not necessarily to scale.

DETAILED DESCRIPTION OF THE DRAWINGS

The present invention provides an improved doctoring device for dewatering paper machine rolls, such as suction press rolls, in which machined features in the roll or other moving surface such as through holes, blind holes (partially drilled holes) and grooves carry away unwanted water that needs to be removed. The doctoring device includes several features that comprise the dewatering capability. The flexibility of the doctoring device is retained by making the dewatering features integral with the holder loading features in certain embodiments. This is accomplished through use of fiber reinforced pultrusion, or metallic extrusion.

The device includes a plurality of mounting structures that are integrally formed as a result of the pultrusion or extrusion process in certain embodiments. Further, the conventional doctor blade wear commodity item may be retained for cleaning the roll surface, and it remains as a separate low cost consumable component. The holder proper with dewatering features then never requires replacement due to wear. Air would be suitable for most applications, although systems of various embodiments of the invention device are also suitable for use with other fluids such as steam, or even liquids.

Figure 1:
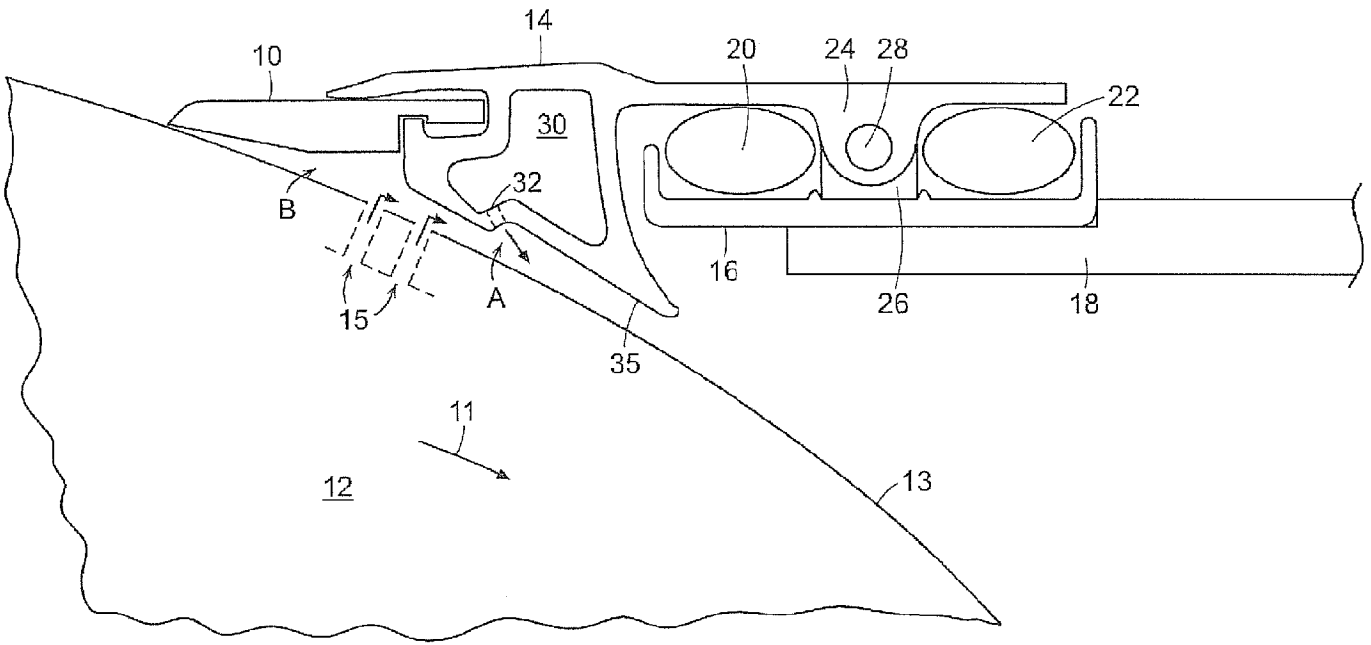
FIG. 1 shows an illustrative diagrammatic view of a doctoring system in accordance with an embodiment of the invention.

In accordance with an embodiment, the invention provides a mechanical and flow device assembly that is used for doctoring paper machine rolls that carry, for example, water. FIG. 1 shows an embodiment of such a system in which the system includes a separate doctor blade 10 for application to a roll 12 that rotates in a direction as sown at 11. The doctor blade 10 is removably received within a receiving area of a doctor blade holder 14. The doctor blade holder 14 is coupled via a tube tray 16 (which is coupled to a doctor-back 18) via mounting structure 24 that is integral to the doctor blade holder 14, which are joined to structures 26 on the tube tray by a rod 28. Unloading tube 20 and loading tube 22 (generally referred to herein as loading tubes 20, 22) alternately remove or apply the doctor blade 10 to the roll surface 12 by alternate introduction or release of a fluid pressure within the loading tubes 20, 22.

Figure 2:
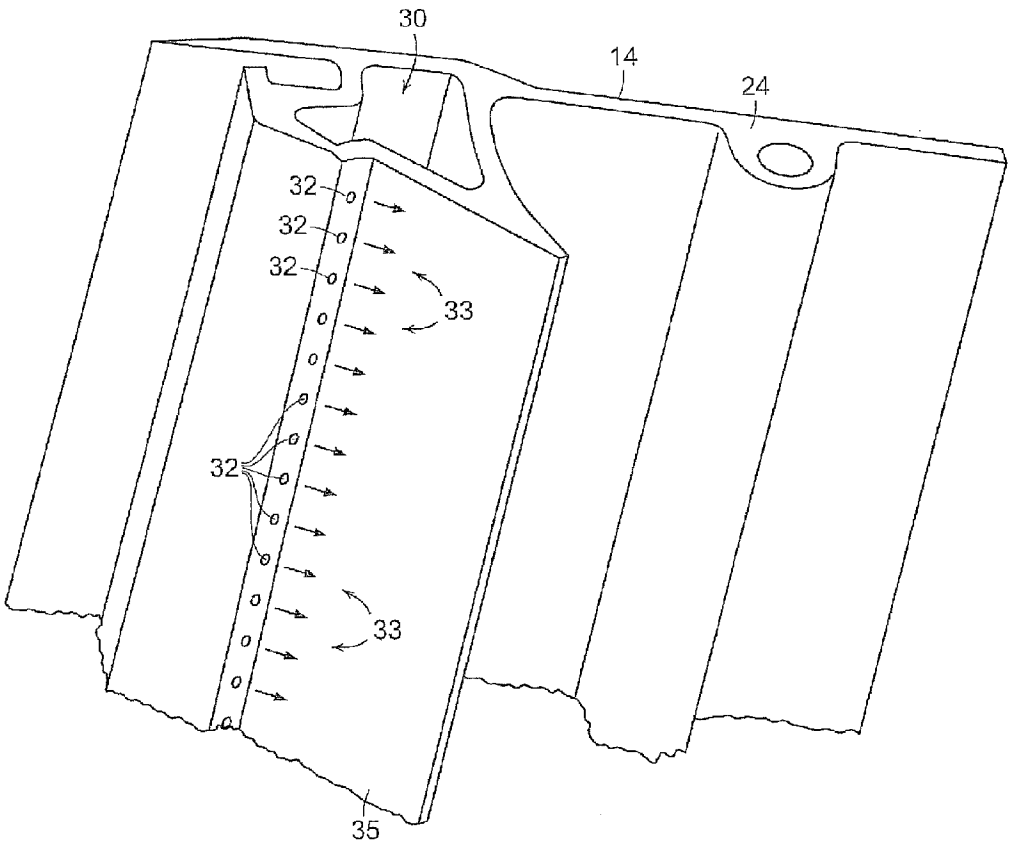
FIG. 2 shows an illustrative diagrammatic view of the underside of the doctor blade holder shown in FIG. 1.

A fluid under positive pressure is provided to a plenum 30, and is released from the plenum 30 via one or more apertures 32. The one or more apertures 32 may comprise a series of apertures along the elongated width of the doctor blade holder 14 as further shown in FIG. 2, or in accordance with other embodiments, may comprise a single elongated aperture or slot as discussed further below, for example, in reference to FIGS. 4-6. The assembly device is loaded via loading tubes 20, 22 in a conventional manner, and includes the integral plenum 30 within the doctor blade holder 14 for delivering pressurized air through the discharge opening 32. The assembly device includes the separate doctor blade 10 that may be removed and replaced without disturbing the positive pressure assembly.

The doctor blade holder 14 may be formed of a fiber reinforced pultrusion, or may also be a metal extrusion in the same or other embodiments. The pultrusion may include a mounting structure 24 that is integrally formed as a result of the pultrusion or extrusion process, as shown further in FIG. 2. In accordance with further embodiments, the mounting structure 24 may be provided as a series of integrally formed mounting structures as discussed further below, for example, in reference to FIGS. 4-6. The device assembly may be used to remove water from rolls with holes (either through holes or blind holes), to remove water from rolls with such holes and grooves, or to remove water from other moving surfaces in a papermaking operation such as moving webs. In other embodiments the plenum feature may be integrated into the stationary tube carrier or may be mounted directly to the doctor-back.

The series of apertures 32 in the doctor blade holder 14 adjoin the plenum 30, and permit fluid such as air to be released from the plenum as shown at A in FIG. 1 in a direction that is generally along a direction of the roll rotation, causing a low pressure area to develop between the following surface of the blade 10 and the roll surface 13 as shown at B. The low pressure draws water from within holes 15 in the roll 12. The holes 15 may be through holes or blind holes. The air shower is directed mostly parallel to but slightly toward the roll, rather than away from the roll. A bounding wall 35 assists in guiding the air in the desired direction.

The primary function of the integral flow plenum and discharge is to create a vacuum under the holder and blade as shown at B in FIG. 1, to assist centrifugal force in evacuating water that resides in the holes 15. With reference again to FIG. 2, the apertures 32 should not be spaced too far apart, and if they are spaced too far apart, a fluid back-up stream may develop between the apertures as shown at 33. These discrete apertures, therefore, may have a disadvantage of introducing a flow path for replenishment air back upstream in-between the apertures if they are spaced too far apart. In order to limit this sealing deficiency, the apertures should be spaced less than one inch apart. Aperture spacing greater than one inch allows increasingly additional replenishment air, which compromises (reduces) the vacuum level. The use of such a doctor blade holder, containing both the fluid nozzle and fluid supply plenum, is very well suited for both upgrades to existing doctoring equipment (e.g., direct retrofit for DST-E holders) and new installations.

Figure 3A:
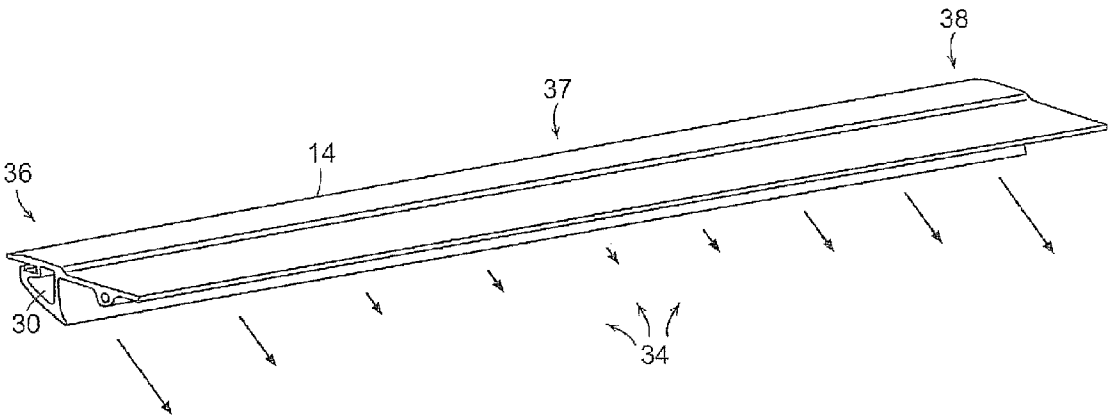
FIGS. 3A and 3B show illustrative diagrammatic views of the doctor blade holder of FIG. 2 with evenly spaced apertures and with unevenly spaced apertures respectively.
Figure 3B:
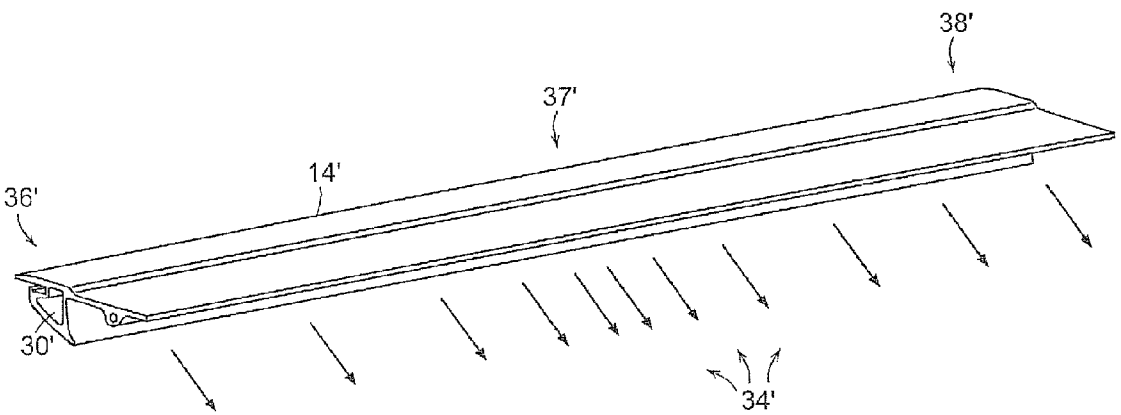

FIG. 3A illustrates that for those cases in which the machine is large, an air pressure drop in the central region within the plenum may be large enough to cause the plenum pressure to be non-uniform as shown at 34, that is, the pressure may be higher near the entrances 36, 38 of the plenum 30 of the doctor blade holder 14, and lower near the middle as shown at 37. This will cause non-uniform air discharge, and may have some non-uniform influence on water removal. In order to compensate for this plenum pressure bias, the aperture spacing may be made variable (e.g., the apertures may be closer together near the middle 37' for a plenum 30' of a doctor blade holder 14' than at the ends 36' and 38') to compensate for the pressure variation, thus maintaining uniform air discharge flow rate as shown at 34' in FIG. 3B.

Figure 4:
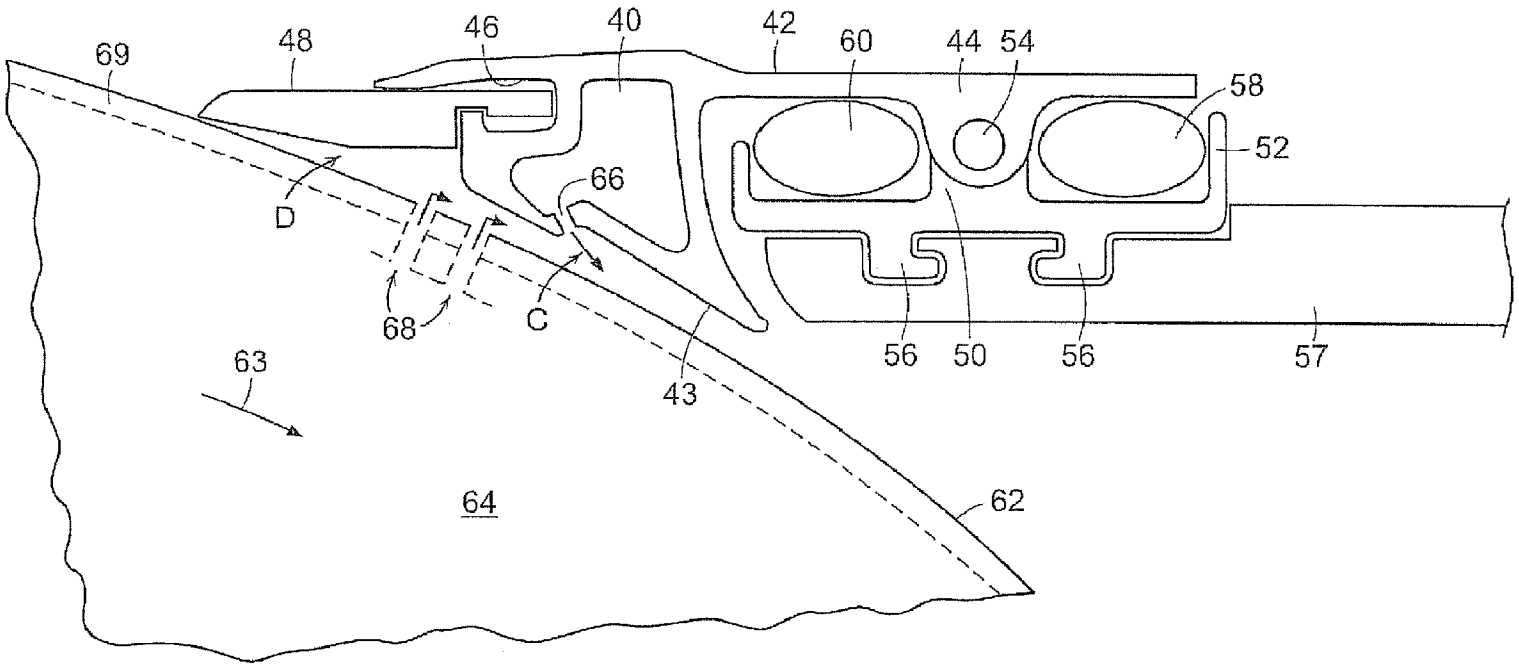
FIG. 4 shows an illustrative diagrammatic view of a doctoring system in accordance with another embodiment of the invention.
Figure 5:
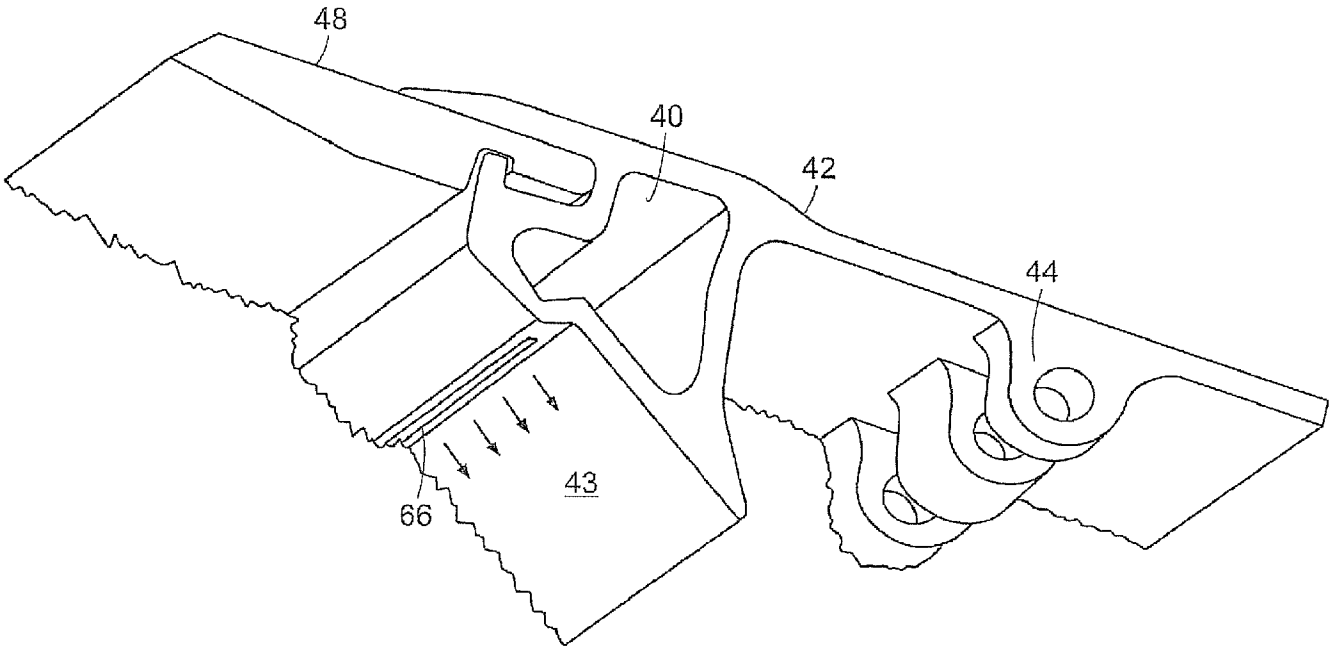
FIG. 5 shows an illustrative diagrammatic view of the underside of the doctor blade and doctor blade holder of FIG. 4.

The air discharge aperture may, in accordance with another embodiment, be a continuous slot, with the air shower again directed mostly parallel to but slightly toward the roll, as rather than away from the roll. In particular and as shown in FIGS. 4 and 5, a plenum 40 is provided within a doctor blade holder 42 that also includes integral mounting structures 44 as well as a blade receiving portion 46 for receiving a doctor blade 48. The integrally formed mounting structures 44 are coupled to integrally formed mounting structures 50 on a tube tray 52 by a rod 54. The tube tray 52 may also include integral doctor-back mounting structure 56 for coupling to a doctor-back 57. Loading tubes 58 and 60 are used to position the blade against a surface 62 or a roll 64 as discussed above with reference to loading tubes 20, 22 of FIG. 1.

A continuous slot opening 66 in the doctor blade holder 42 adjoins the plenum 40, and permits fluid such as air to be released from the plenum as shown at C in a direction that is generally along a direction of the roll rotation (shown at 63), causing a low pressure area to develop between the following surface of the blade 48 and the roll surface 62 as shown at D. The low pressure draws water from within the holes 68 and grooves 69 in the roll 64.

A bounding wall 43 assists in guiding the air in the desired direction. The air shower at high velocity interacts with the resident ambient air under the holder, imposing significant shear on it, thus entraining the resident air in the flow direction which coincides with roll rotation direction. This through-air flow under the holder is replenished by air ingress from unsealed locations about the holder. Since the slot is continuous, it in principle seals against the flow of replenishment air that would otherwise tend to flow back upstream into the vacated volume under the holder and blade.

Figure 6:
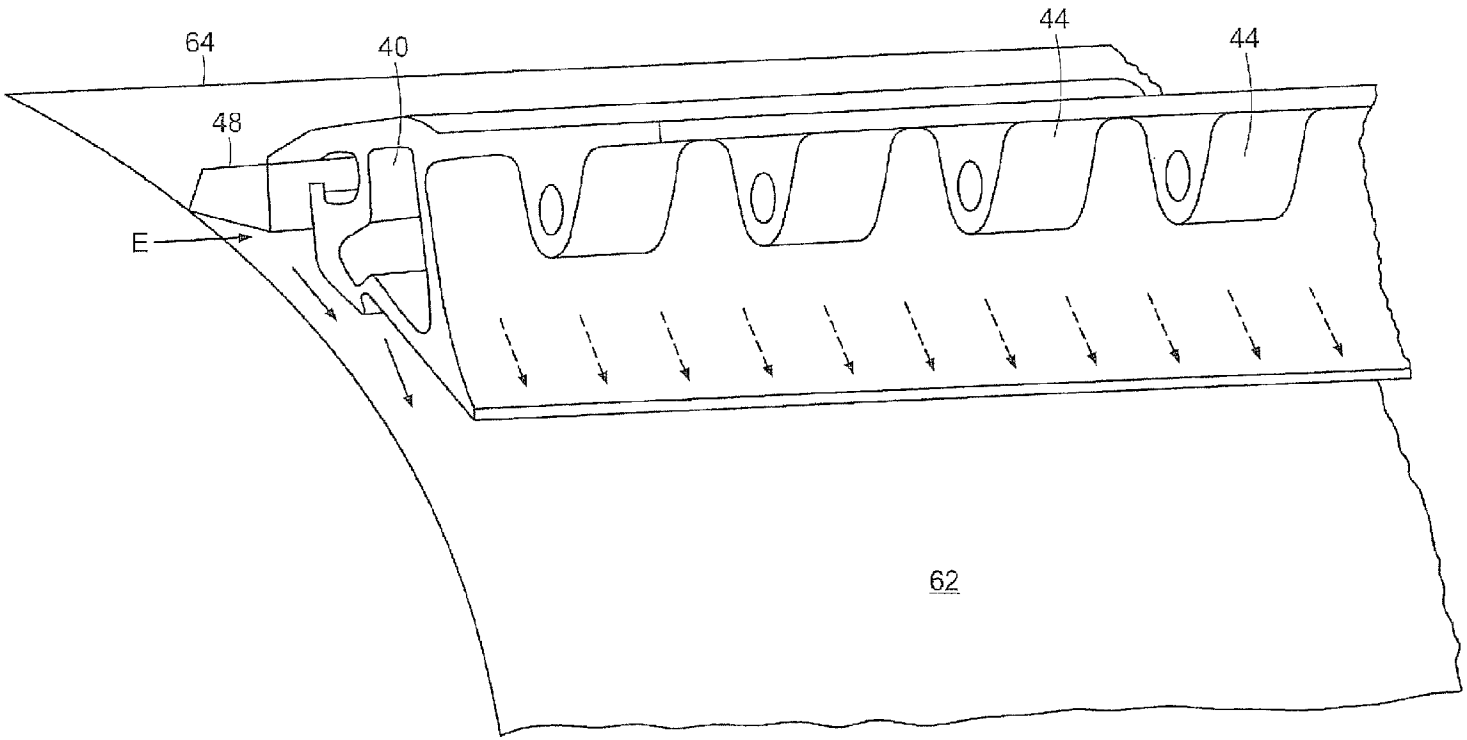
FIG. 6 shows an illustrative diagrammatic view of the proximal side of the doctor blade and doctor blade holder of FIG. 4.

As shown at E in FIG. 6, a source of replenishment air is from the edges of the blade and holder. As long as there is resistance to the flow of replenishment air, then a vacuum will be created under the holder and blade, and that vacuum will assist in dislodging water from the holes. Higher vacuum levels may be achieved by increasing air discharge flow rate, and decreasing the flow of replenishment air. Conversely, through-air flow under the blade and holder can be raised by increasing both air plenum discharge flow rate and replenishment air through the blade edges. In some applications it may be more advantageous to only achieve some nominal vacuum, rather than maximize vacuum, and instead combine higher replenishment flow rates (through the ends) with nominal vacuum, to assist in carrying away resident water in high speed machines, such as for example in tissue making machines.

Figure 7:
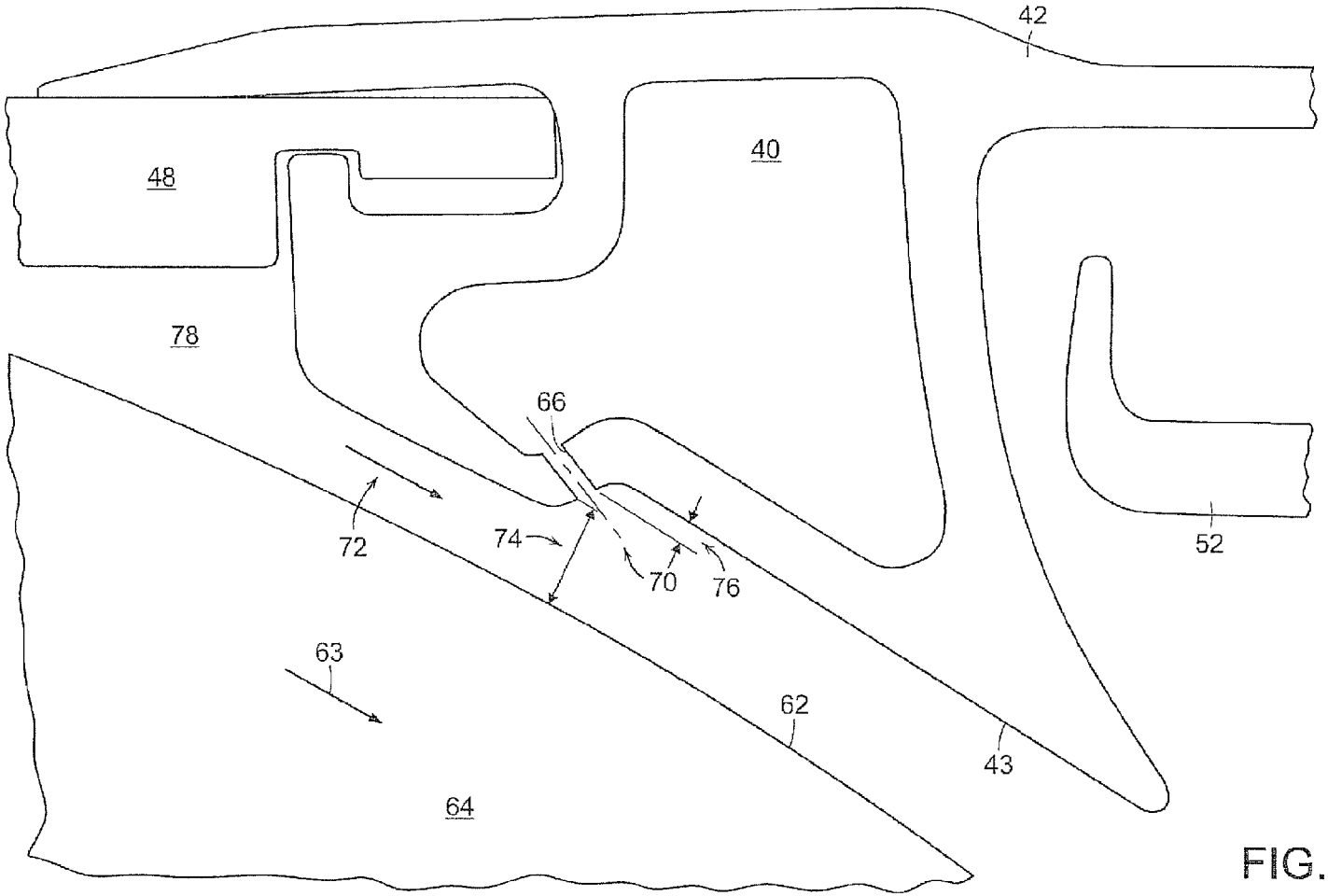
FIGS. 7 and 8 show illustrative diagrammatic views of doctoring systems in accordance with further embodiments of the invention.

As shown in FIG. 7, the air discharge area (as shown at 70), whether through the continuous slot or series of holes, is located as close as possible (as shown at 74) to the through-air path 72, so as to allow the most effective shearing of resident air, producing higher vacuum. The air discharge area 70 should also be located close to the bounding wall 43 (as shown at 76) of the doctor blade holder 42 to produce high vacuum in an area 78 beneath the following surface of the doctor blade 48.

Figure 8:
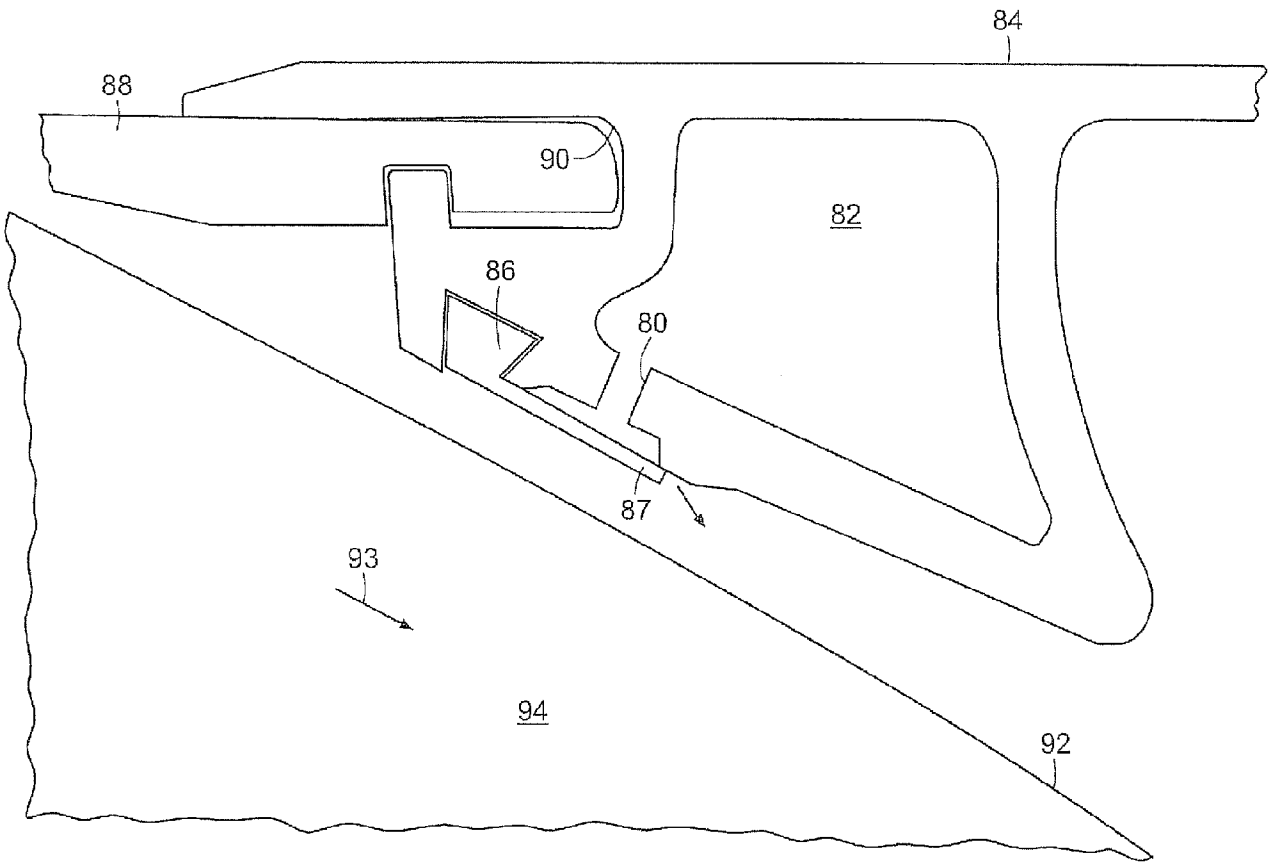

In accordance with a further embodiment as shown in FIG. 8, a discharge opening 80 (provided as either a series of holes or a continuous slot) is in communication with a plenum 82 on a doctor blade holder 84. The discharge opening 80 is also in communication with a preloaded flapper spring 86 (formed for example of a synthetic or metallic material) having a discharge end portion 87 that will open to a desired continuous gap at pressure, delivering the appropriate air flow discharge under operating conditions. The preloaded flapper spring 86 may be formed of an elongated shape that is received within a complementary elongated shaped recess within the doctor blade holder as shown. The doctor blade holder 84 may also receive doctor blade 88 in a receiving area 90 for cleaning a surface 92 of a roll 94 that rotates in a direction as indicated at 93. The roll 94 may include holes (through or blind holes) as well as grooves as discussed above. When the air discharge is not needed, the pressure is turned off and the flapper will close the gap, preventing ingress of unwanted contaminants. In the absence of the preloaded flapper, pressurized air may be required to keep contaminants from entering the plenum during machine outages.

Figure 9:
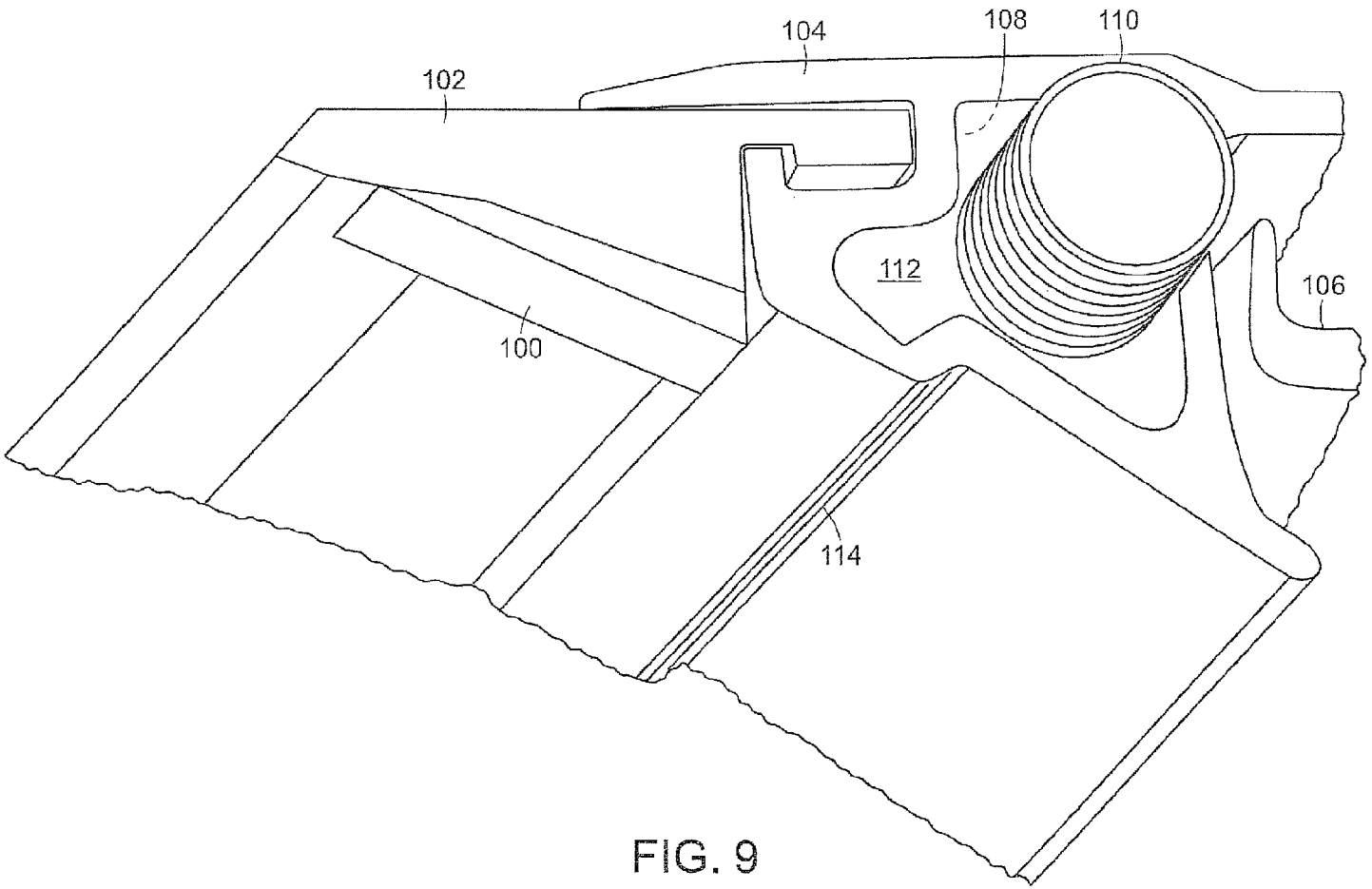
FIGS. 9 and 10 show illustrative diagrammatic views of the underside of doctor blades and doctor blade holders in accordance with further embodiments of the invention.
Figure 10:
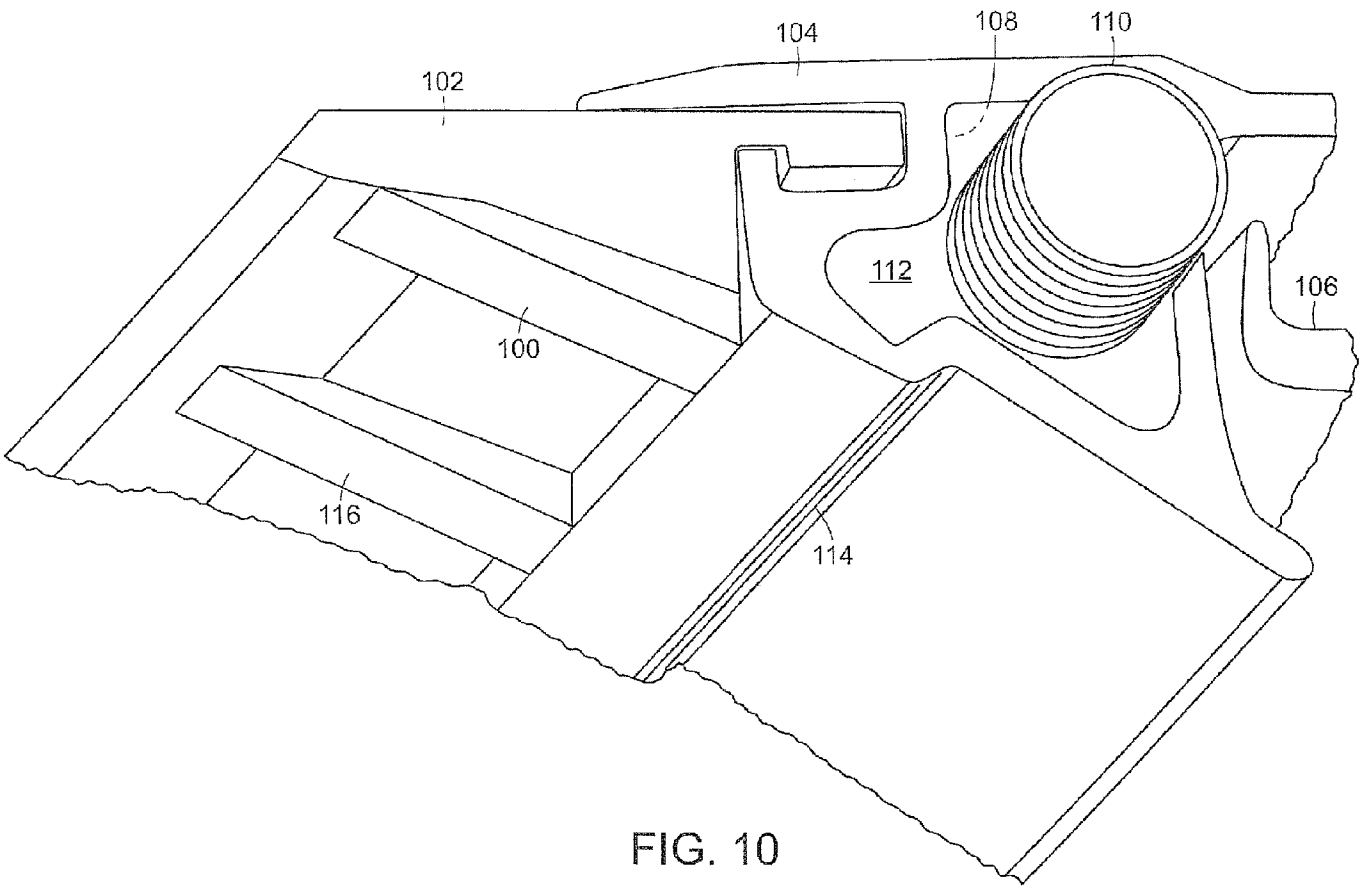
Figure 11:
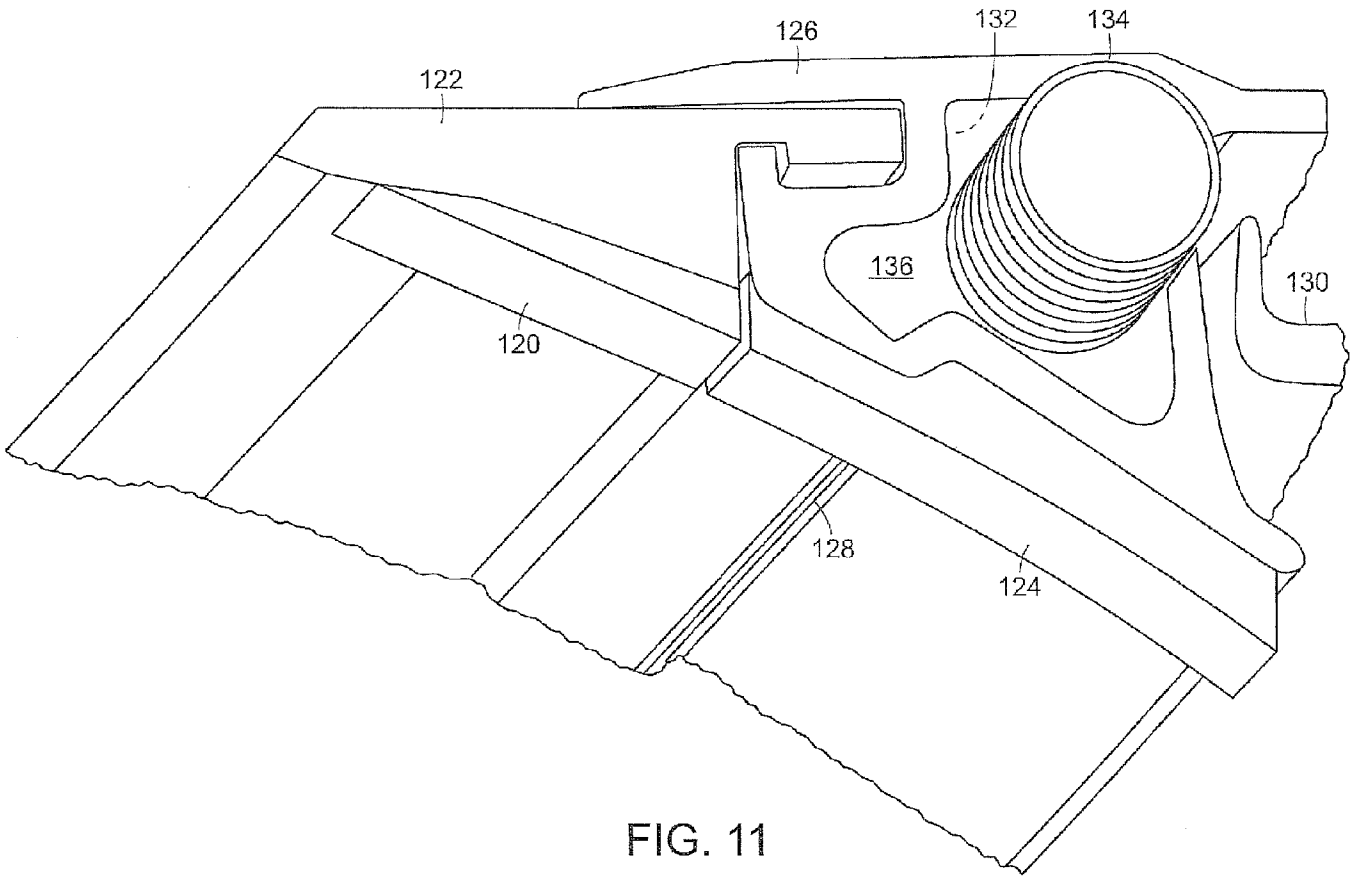
FIGS. 11 and 12 show illustrative diagrammatic views of the underside of a doctor blade and a doctor blade holder in accordance with further embodiments of the invention.
Figure 12:
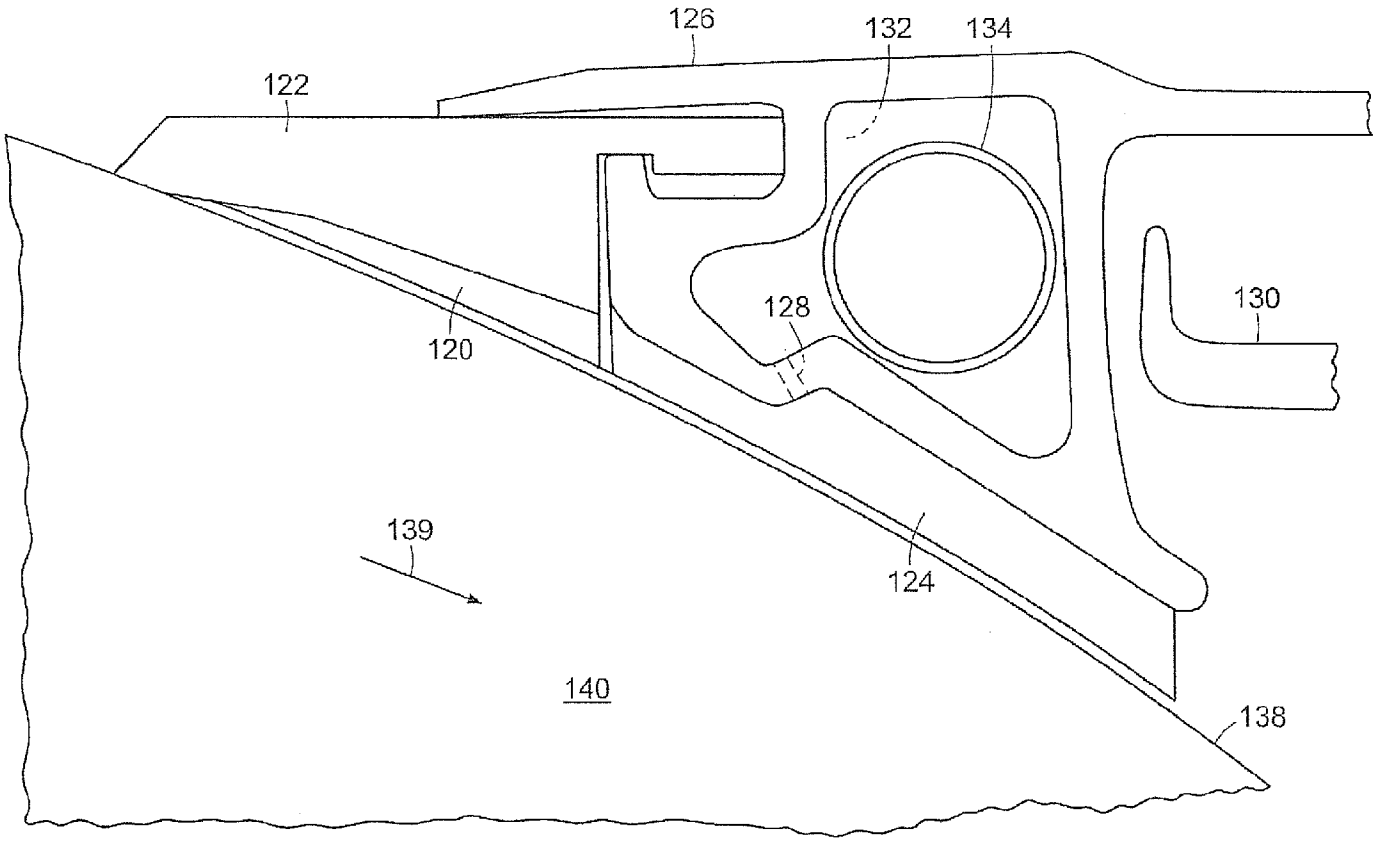

To limit replenishment air that enters through the edges of the blade and holder, two or more shrouded wall features may be added to the doctor blade as shown in FIGS. 9 and 10, to the doctor blade holder, or both as shown in FIGS. 11 and 12. In particular, as shown in FIG. 9 a shroud 100 may be located at each of the two ends (one of which is shown) of a doctor blade 102. The shrouds inhibit replenishment air from entering into the area under the doctor blade 102. The doctor blade 102 is coupled to a doctor blade holder 104, which in turn is coupled to a tube tray 106 as discussed above. The air is provided to the plenum 108 via a conduit port 110, and the plenum 108 includes a sealed end structure 112 through which the port 110 communicates with the plenum 108. An aperture in the form of a continuous slot 114 (or series of apertures) is in communication with the plenum 108 as discussed above for providing a discharge of a fluid such as air is that directed mostly parallel to but slightly toward the roll.

As further shown in FIG. 10 (where like elements are designated with the same reference numerals as in FIG. 9, the doctor blade 102 may further include a plurality of intermediate shrouds 116 that are positioned at spaced apart locations along the underside of the doctor blade 102.

As shown in FIGS. 11 and 12 a shroud 120 may be located at each of the two ends of a doctor blade 122 (again only one is shown), and a shroud 124 may be located at each of the two ends (one is shown) of a doctor blade holder 126. The shrouds 120 inhibit replenishment air from entering into the area under the doctor blade 122 and the shrouds 124 inhibit replenishment air from entering into the area under the doctor blade holder 126. The doctor blade 122 is coupled to the doctor blade holder 126, which in turn is coupled to a tube tray 130 as discussed above. The air is provided to the plenum 132 via a conduit port 134, and the plenum 132 includes a sealed end structure 136 through which the port 134 communicates with the plenum 132. The aperture 128 is in the form of a continuous slot and is in communication with the plenum 132 as discussed above for providing a discharge of a fluid such as air is that directed mostly parallel to but slightly toward the roll 140 as it rotates in a direction as indicated at 139.

As further shown in FIG. 12, the shrouds 120 and 124 (as well as the shrouds 100 and 116 in FIGS. 9 and 20), are positioned close to the surface 138 of a roll 140 to be processed. The shrouds 100 116 and 120 may be formed integral with the doctor blade, and the shrouds 124 may be formed integral with the doctor blade holder.

The doctor blade will wear as a result of contact with the roll surface. As the blade wears, the holder and integral plenum will rotate and translate towards the roll. As its position and orientation to the roll surface changes, the performance will change. In order to maintain a near constant position to the roll surface over long periods of time, the preferred blade geometry is one in which the blade wear rate is low; one such blade is one in which the shrouded end is reproduced periodically along its length, as discussed above with reference to FIG. 10. Alternatively, the thicker shrouded profile may be extruded along the blades entire length, resulting in a thick, constant cross sectional blade. Such a thick cross-sectional blade also offers advantageous sealing against edge replenishment air, thus in conjunction with the doctor blade holder it increases vacuum levels under the doctor blade holder.

Doctor blade holders of certain embodiments of the present invention are designed to receive an individual doctor blade as disclosed above. Individual doctor blades retain a great deal of flexibility along the elongated direction. The flexibility is important in allowing the blade to negotiate misalignment and crowned roll surfaces, as well as other variations. This flexibility is a primary determinant of effective doctoring and increasing this flexibility has been the goal of doctor blade and doctor assembly design for decades. The use of an integral doctor blade and doctor blade holder, as disclosed for example in U.S. Pat. No. 6,491,791) inhibits flexibility and decrease the doctoring effectiveness. Specific to the dewatering application, the stiff blade would have difficulty negotiating the roll surface, and as such would allow replenishment air to pass under the blade tip at non-contacting locations, diluting the vacuum. Water removal would be compromised.

Certain prior art doctoring systems include grafted commodity wear components (doctor blades) onto capital items (doctoring assemblies) requiring disposal of the entire capital item when the commodity wear item is exhausted. In contrast, the present invention keeps the wear item doctor blade separate from the capital item, requiring replacement of only the doctor blade to restore the doctoring assembly to its original performance level.

Figure 13:
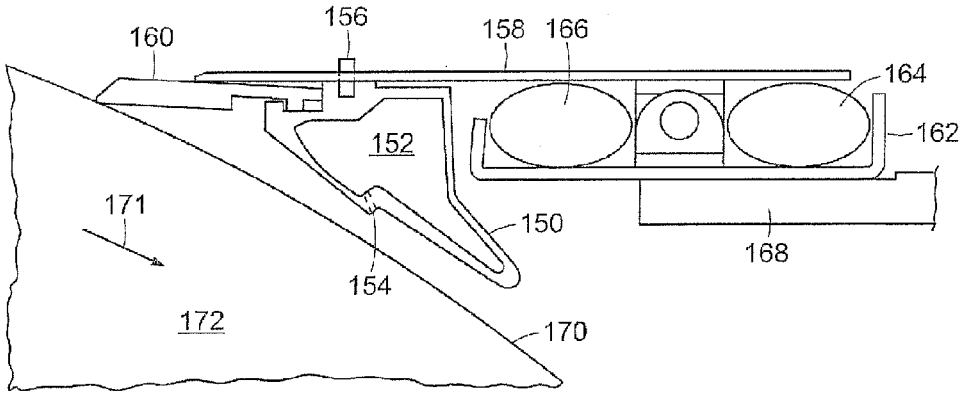
FIGS. 13-16 show illustrative diagrammatic views of doctoring systems in accordance with further embodiments of the invention.

FIG. 13 shows a further embodiment of the invention wherein a separate flow device member 150 that includes a plenum 152 and one or more apertures 154 is attached with fasteners 156 to a top plate 158 of a doctoring system. A doctor blade 160 is attached to the member 150, and the top plate 158 is rotatably coupled to a tube tray 162. In this case, the flow device member 150 also provides the necessary support for the underside of the doctor blade 160. Preferably this flow device member is made from a pultruded fiber reinforced plastic (FRP) or metallic extrusion. The outer, roll-facing, profile of this flow device member, along with the air discharge orientation is identical to that of the first embodiment described above. The tube tray 162 includes loading tubes 164 and 166 (as discussed above), and is coupled to a doctor-back 168. The doctor blade cleans a surface 170 of a roll 172 as discussed above while a fluid such as air that is provided to the plenum 152 is directed through the one or more apertures 154 to provide dewatering of the roll 172 as the roll rotates in a direction as indicated at 171.

Figure 14:
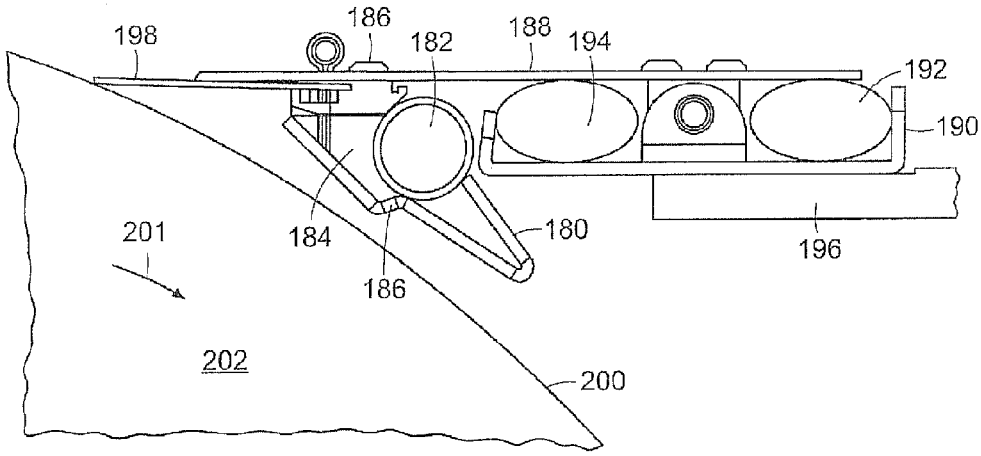

FIG. 14 shows a further embodiment of the invention wherein the flow device member 180 is fabricated from a metal such as stainless steel rather than being a pultruded fiber reinforced plastic (FRP) or metallic extrusion. The separate flow device member 180 includes an inner plenum 182, an intermediate plenum 184 and one or more apertures 186 (as discussed above). The member 180 is attached with fasteners 186 to a top plate 188 of a tube tray 190 that includes loading and unloading tubes 192, 194. The tube tray 190 is coupled to a doctor-back 196. A doctor blade 198 is attached to the top plate 188, and the top plate 188 is rotatably coupled to a tube tray 190. The doctor blade cleans a surface 200 of a roll 202 as it rotates in a direction as indicated at 201 as discussed above, while a fluid such as air that is provided to the plenum 182. Fluid such as air from within the plenum 184 is directed through the one or more apertures 186 to provide dewatering of the roll 202 as discussed above.

Figure 15:
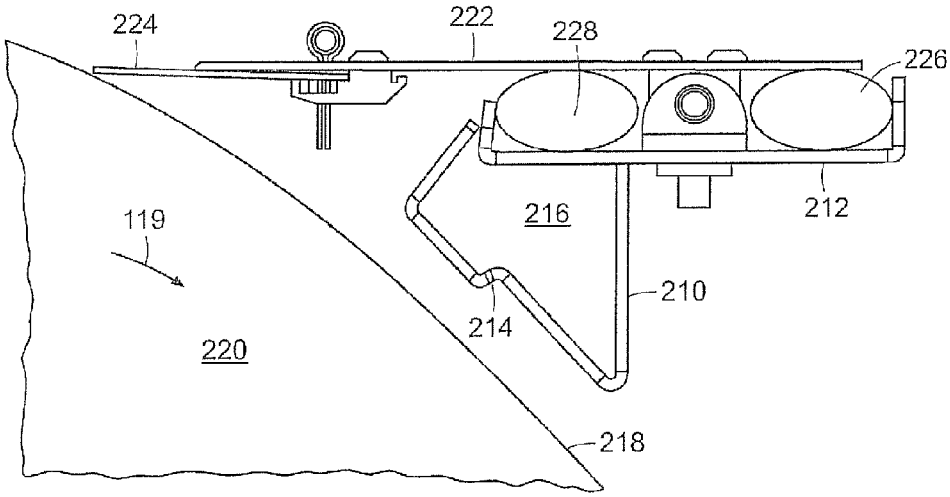

FIG. 15 shows a further embodiment of the invention wherein the flow device member 210 is an integral part of the tube tray 212 of a doctoring system. This flow device member 210 and tube tray member 212 may be made from a pultruded fiber reinforced plastic (FRP) or metallic extrusion, or could be fabricated from a metal such as stainless steel. The outer, roll-facing, profile of this flow device member, along with the orientation of the fluid discharge aperture 214 is the same as that of the above embodiments above. The flow device member 210 includes an internal plenum 216 and one or more apertures 214 for providing fluid such as air generally along the surface 218 of the roll 220 that rotates in a direction as indicated at 119 as described above. A top plate 222 is rotatably coupled to the tube tray 212, and a doctor blade 224 is attached to the top plate 222. Movement of the doctor blade 224 with respect to the tube tray 212 is provided by loading and unloading tubes 226 and 228 as discussed above. The doctor blade cleans the surface 218 of the roll 220 as discussed above while a fluid such as air that is provided to the plenum 216 is directed through the one or more apertures 214 to provide dewatering of the roll 220 as discussed above.

Figure 16:
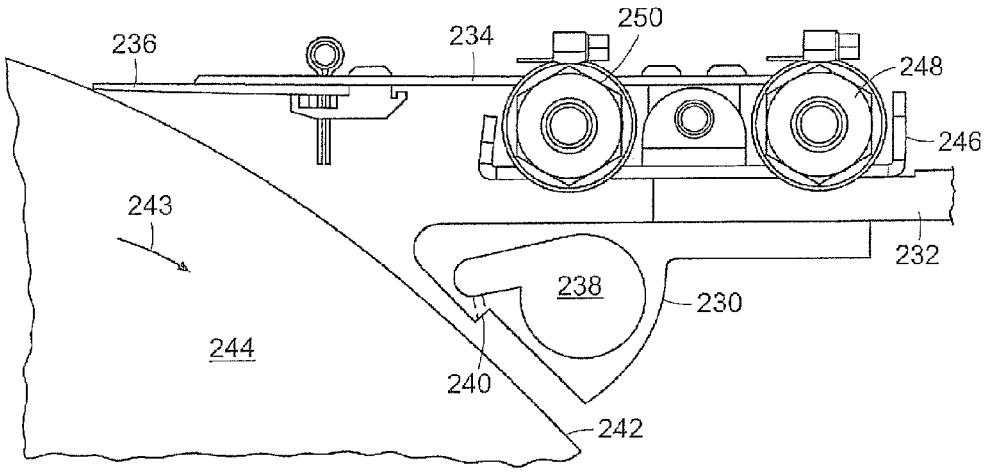

FIG. 16 shows a further embodiment of the invention wherein the flow device member 230 is attached with fasteners to a doctor-back 232 in close proximity to the doctor blade holder 234 and doctor blade 236. The flow device member 230 includes a plenum 238 and one or more apertures 240 for providing fluid generally along the surface 242 of a roll 244 as described above. The member 230 is directly attached to the doctor-back 232, and a tube tray 246 is attached to the doctor-back 232, while the top plate 234 is rotatably coupled to the tube tray 246. Movement of the doctor blade 236 with respect to the tube tray 246 is provided by loading and unloading tubes 248 and 250 as discussed above. Preferably this flow device member and tube tray member is made from a pultruded fiber reinforced plastic (FRP) or metallic extrusion. The outer, roll-facing, profile of this flow device member, along with the nozzle orientation is identical to that of the first embodiment described above. The doctor blade cleans the surface 242 of the roll 244 as discussed above while a fluid such as air that is provided to the plenum 238 is directed through the one or more apertures 240 to provide dewatering of the roll 244 as discussed above.

Those skilled in the art will appreciate that numerous modifications and variations may be made to the above disclosed embodiments without departing from the spirit and scope of the invention.

What is claimed is:

1. A doctoring system for a papermaking machine, said doctoring system comprising:

a doctor blade coupled to a doctor blade holder, said doctor blade for cleaning a moving surface, and said doctor blade holder being coupled to a doctor-back;

fluid assist means for providing a fluid under positive pressure that is higher than atmospheric pressure, said fluid being directed in a direction generally along a direction of movement of the moving surface to entrain air that is adjacent the moving surface and a following surface of the doctor blade such that a negative pressure that is lower than atmospheric pressure develops in a negative pressure zone adjacent the moving surface and the following surface of the doctor blade during movement of the moving surface, wherein said fluid assist means includes at least one aperture in the doctor blade holder, wherein said aperture is proximate the moving surface following the doctor blade and is in communication with a plenum that is internal to the doctor blade holder, and wherein the doctor blade holder includes a first surface that is proximate to and generally follows the moving surface following the doctor blade and is separated from the moving surface by a first distance, and the doctor blade holder includes a second surface that generally follows the moving surface and is separated from the moving surface by a second distance, wherein the second distance is larger than the first distance and wherein the at least one aperture is located between the first and second surfaces of the doctor blade holder.

2. The doctoring system as claimed in claim 1, wherein said doctor blade holder is formed of a pultruded material.

3. The doctoring system as claimed in claim 2, wherein said pultruded material includes a composite of fiber and polymeric resin.

4. The doctoring system as claimed in claim 1, wherein said fluid under positive pressure is provided from a plenum within the doctor blade holder.

5. The doctoring system as claimed in claim 1, wherein said fluid under pressure is provided from a plenum that is structurally separate from the doctor blade holder.

6. The doctoring system as claimed in claim 5, wherein said plenum is attached to one of the doctor blade and the doctor blade holder.

7. The doctoring system as claimed in claim 5, wherein said plenum is attached to the doctor-back.

8. The doctoring system as claimed in claim 1, wherein said fluid assist means is formed as a separate structure than the doctor blade, permitting doctor blades to be attached and removed in the doctoring system without affecting the fluid assist means.

9. The doctoring system as claimed in claim 1, wherein said fluid under positive pressure is provided from a plenum via an elongated aperture in the doctor blade holder.

10. The doctoring system as claimed in claim 1, wherein said fluid under positive pressure is provided from a plenum via an elongated aperture in the doctor blade holder, said aperture formed by the deflection of a flapper spring away from a surface of the doctor blade holder when the fluid is under positive pressure.

11. The doctoring system as claimed in claim 10, wherein said flapper spring is preloaded against the holder, thus sealing the plenum from external contaminants during a machine outage.

12. The doctoring system as claimed in claim 1, wherein said fluid under positive pressure is provided from a plenum within the doctor blade holder via a plurality of apertures along an elongated portion of the doctor blade holder.

13. The doctoring system as claimed in claim 12, wherein said plurality of apertures along the elongated portion of the doctor blade holder are mutually spaced from one another in an uneven manner to facilitate a uniform discharge flow of the fluid along the elongated width of the doctor blade holder.

14. The doctoring system as claimed in claim 1, wherein said fluid under positive pressure is provided from a plenum within a plenum structure that is coupled to the doctor-back.

15. The doctoring system as claimed in claim 1, wherein said doctor blade holder includes a plurality of mounting structures disposed along at least a portion of an elongated length of a doctor blade, said plurality of mounting structures for facilitating pivotally coupling the doctor blade holder to the doctor-back.

16. The doctoring system as claimed in claim 15 wherein said mounting structures assist in pivotally coupling the doctor blade holder to the doctor-back by attaching the doctor blade holder to a tube tray that includes at least one position adjustable tube.

17. The doctoring system as claimed in claim 15, wherein said mounting structures are integrally formed with the doctor blade holder.

18. The doctoring system as claimed in claim 1, wherein said doctoring system further includes shroud walls on each opposing end of the doctor blade holder adjacent the moving surface to assist in the formation of negative pressure by restricting replenishment air at the opposing ends.

19. A doctoring system for a papermaking machine, said doctoring system comprising:

a doctor blade coupled to a doctor blade holder, said doctor blade for de-watering a roll that includes holes, and said doctor blade holder being coupled to a doctor-back;

fluid assist means for providing air under positive pressure that is higher than atmospheric pressure, said air being directed in a direction generally along a direction of rotation of the roll such that a negative pressure that is lower than atmospheric pressure develops in a negative pressure zone adjacent the moving surface and a following surface of the doctor blade during rotation of the roll for drawing water from within the holes in the roll surface, wherein said fluid assist means includes at least one aperture in the doctor blade holder, wherein said aperture is proximate the roll surface following the doctor blade and is in communication with a plenum that is internal to the doctor blade holder, and wherein the doctor blade holder includes a first surface that is proximate to and generally follows the roll surface following the doctor blade and is separated from the roll surface by a first distance, and the doctor blade holder includes a second surface that generally follows the roll surface and is separated from the roll surface by a second distance, wherein the second distance is larger than the first distance and wherein the at least one aperture is located between the first and second surfaces of the doctor blade holder.

20. A method of treating a roll surface during papermaking, said method comprising the steps of:

coupling a doctor blade holder to a doctor-back using;

pivotally adjusting the doctor blade with respect to the doctor-back; and providing a positive air pressure that is higher than atmospheric pressure, said positive air pressure causing air to be directed in a direction that is generally toward a direction of rotation of the roll such that a negative pressure that is lower than atmospheric pressure is provided in a negative pressure area adjacent a surface of the roll and adjacent a following surface of the doctor blade and doctor blade holder during rotation of the roll, wherein said step of providing the positive air pressure includes providing air through at least one aperture in the doctor blade holder, wherein the aperture is proximate the surface of the roll following the doctor blade and is in communication with a plenum that is internal to the doctor blade holder, and wherein the doctor blade holder includes a first surface that is proximate to and generally follows the surface of the roll following the doctor blade and is separated from the surface of the roll by a first distance, and the doctor blade holder includes a second surface that generally follows the surface of the roll and is separated from the surface of the roll by a second distance, wherein the second distance is larger than the first distance and wherein the at least one aperture is located between the first and second surfaces of the doctor blade holder.

* * * * *